US012484715B2

(12) United States Patent
Cianetti et al.

(10) Patent No.: US 12,484,715 B2
(45) **Date of Patent: *Dec. 2, 2025**

(54) FRAME FOR SUPPORTING A RETAINING ELEMENT FOR A PANEL OF A DISPLAY CABINET

(71) Applicant: NEM USA INC., Brooklyn, NY (US)

(72) Inventors: Alessandro Cianetti, Gorizia (IT); Jacopo Cianetti, Gorizia (IT)

(73) Assignee: NEM USA INC., Brooklyn, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/746,691

(22) Filed: Jun. 18, 2024

(65) Prior Publication Data

US 2025/0000277 A1 Jan. 2, 2025

Related U.S. Application Data

(63) Continuation-in-part of application No. 18/215,489, filed on Jun. 28, 2023.

(51) Int. Cl.
*A47F 3/12* (2006.01)
*A47F 3/00* (2006.01)

(52) U.S. Cl.
CPC ..... *A47F 3/007* (2013.01); *A47F 2003/008* (2013.01)

(58) Field of Classification Search
CPC .. A47F 3/12; A47F 3/007; A47F 3/125; A47F 5/0815; A47F 2003/008
USPC ..... 312/137, 138.1, 139, 319.8
See application file for complete search history.

(56) References Cited

U.S. PATENT DOCUMENTS

| | | | | |
|---|---|---|---|---|
| 4,185,415 | A | 1/1980 | LaConte | |
| 4,842,349 | A | 6/1989 | Stenemann | |
| 5,112,118 | A * | 5/1992 | Wiehle | A47F 3/007 49/340 |
| 5,116,274 | A * | 5/1992 | Artwohl | A47F 3/007 312/405 |
| 5,207,490 | A * | 5/1993 | Kaspar | A47F 3/007 312/405 |
| 5,639,149 | A * | 6/1997 | Grassmuck | A47F 3/007 277/645 |
| 5,810,460 | A * | 9/1998 | Hansen | A47F 3/007 312/328 |
| 6,634,460 | B1 * | 10/2003 | Hackenberg | E05F 1/1091 186/59 |
| 6,758,539 | B2 * | 7/2004 | Cianetti | E05D 15/34 312/139.2 |
| 7,877,931 | B2 * | 2/2011 | Cianetti | A47F 3/007 312/328 |

(Continued)

OTHER PUBLICATIONS

U.S. Appl. No. 18/746,654, filed Jun. 18, 2024 in the name of Cianetti et al.

(Continued)

*Primary Examiner* — James O Hansen
(74) *Attorney, Agent, or Firm* — Oliff PLC

(57) ABSTRACT

A frame for supporting a panel of a display cabinet or counter for show-casing and selling food and non-food products. A fixing mechanism of a retaining element within a section of a frame of said display cabinet or counter advantageously allows a quick assembly/disassembly and a robust and safe support for the retaining element.

11 Claims, 8 Drawing Sheets

(56) References Cited

U.S. PATENT DOCUMENTS

| | | | | |
|---|---|---|---|---|
| 8,292,376 | B1 * | 10/2012 | Stelmasik | E05F 1/1091 49/386 |
| 2008/0047912 | A1 | 2/2008 | Cianetti | |
| 2008/0174216 | A1 | 7/2008 | Bries et al. | |
| 2008/0238276 | A1 * | 10/2008 | Migli | E05F 15/614 16/277 |
| 2013/0098184 | A1 | 4/2013 | Cianetti | |

OTHER PUBLICATIONS

Mar. 24, 2025 Office Action issued in U.S. Appl. No. 18/215,489.
Apr. 9, 2025 Office Action issued in U.S. Appl. No. 18/746,654.
Apr. 9, 2025 Office Action issued in U.S. Appl. No. 18/215,527.

* cited by examiner

FRAME FOR SUPPORTING A RETAINING ELEMENT FOR A PANEL OF A DISPLAY CABINET

This is a Continuation-in-Part of application Ser. No. 18/215,489 filed Jun. 28, 2023. The disclosure of the prior application is hereby incorporated by reference herein in its entirety.

TECHNICAL FIELD OF THE INVENTION

The present invention relates to a frame for supporting a retaining element for a panel of a display cabinet or counter for show-casing and selling food and non-food products. In particular, the invention relates to a fixing mechanism of a retaining element within a section of a frame of said display cabinet or counter, which mechanism allows advantageously a quick assembly and a robust and safe support for the retaining element.

BACKGROUND OF THE INVENTION

According to the prior art, counters and display cabinets for show-casing and selling products are always provided with glass sheets or sheets made of transparent plastic material. These display cabinets have the function of isolating the products from the external environment for a correct preservation and/or for preventing customers from touching them with the risk of contaminations, damage of theft. However, the products must be clearly visible and easily reachable, when needed, thanks to mechanisms for lifting one or more sheets of said counters or display cabinets. To this end, the sheets are constrained in various ways to an upper frame supported by uprights or to a lower frame fixed to the counter or display cabinet.

Among the various systems for fixing sheets to the upper frame, some provide for lifting/rotating each sheet upwards in order to gain access into the inside of the counter, as mentioned, to replenish the goods on display or simply to clean the counter or display cabinet, sheets comprised.

Regardless of the lifting/rotating system used, each sheet must be capable of staying open in a sufficiently high position and in a stable safety position so as to be able to gain access into the counter or display cabinet without danger of the operator knocking his/her head. This is achieved by lifting the sheet upwards by rotating it using appropriately calibrated hinge systems and retaining springs. Once the goods have been loaded and/or unloaded and/or the necessary cleaning has been carried out, said sheets may be returned to their sales service position that to close the display compartment.

In the known systems for fixing to an upper frame which allow the rotation of the sheet, a typical drawback consists in the difficulty or laboriousness of the assembly of one end, for instance, of a gas strut within the corresponding housing into the frame of a display cabinet or counter.

As a matter of fact, as known, a display cabinet or counter for showcasing products, especially food products, comprises a generally closed base for resting on the ground, on which there is fixed a shelf where the products are placed. This shelf is then surmounted by a frame carrying a plurality of panels adapted—on the one hand—to prevent direct contact with the products and their preservation, and—on the other hand—allow them to be viewed. The panels or sheets may be made of glass or transparent plastic and can be on all sides—upper, front, rear and lateral—depending on the needs or preferences. In any case, at least one of the two front and rear sides, that is the first facing towards the operators and the second towards the customers, can be opened to allow the handling of products and the interior and exterior cleaning of the panels.

The frame comprises at least one pair of uprights fixed—with one end—to such shelf and—at the opposite end—to a corresponding support of the movement system of a panel or sheet. In particular, the support is a box-like section which extends straight along an axis and it is provided with a first opening—at one end—for fixing with a rotary element and a second opening facing towards the shelf when the system is in operative position. The second opening allows the insertion of a first fork-like end of a gas strut for sustaining the opening and closing of the panel. As a matter of fact, the gas strut is assembled by inserting said first fork-like end into the section so that the arms of the fork are in a plane orthogonal to the opening plane. In this position, the fork engages a transversely locked pin at the bottom of the section, so as to allow the rotation of the gas strut which follows the opening and closing movement of the panel. This operation is laborious given that the second opening only extends for a short portion of the section, only in proximity of the first opening, and it is therefore difficult to centre the pin with the fork.

Furthermore, it has been observed that after a number of opening/closing cycles or due to abrupt opening/closing movements, the fork disengages from the pin and completely loses the support required for the correct rotation and operation of the gas strut.

Obviously, such drawback is very dangerous given that it entails that the system will be released from the section and from the upright with the risk of the entire panel falling or breaking.

SUMMARY OF THE INVENTION

The scope of the present invention is thus to design a mechanism for fixing to a frame a retaining element for panels or slabs of a display cabinet or counter for show-casing and selling products that solves the problems outlined above.

Therefore, a first object of the invention is a frame for supporting a retaining element of sheets comprising its fixing mechanism easy to be assembled within a section.

A second object is a fixing mechanism of said retaining element, that is robust and safe so that to allow lifting the panels and preventing dangerous and unwanted release of the gas strut.

BRIEF DESCRIPTION OF THE FIGURES

Advantages, characteristics and other objects of the invention will be apparent from the following description, provided by way of non-limiting example, with reference to the attached figures, wherein.

DETAILED DESCRIPTION OF THE INVENTION

The idea on which the present invention is based is to provide a system for assembly the moving mechanism of panels or sheets within the supporting frame which system is easier with respect to the known systems.

Therefore, a particular geometry of the elements for fixing a retaining element as a gas strut within the section of the frame.

Figures 1A, 1B:
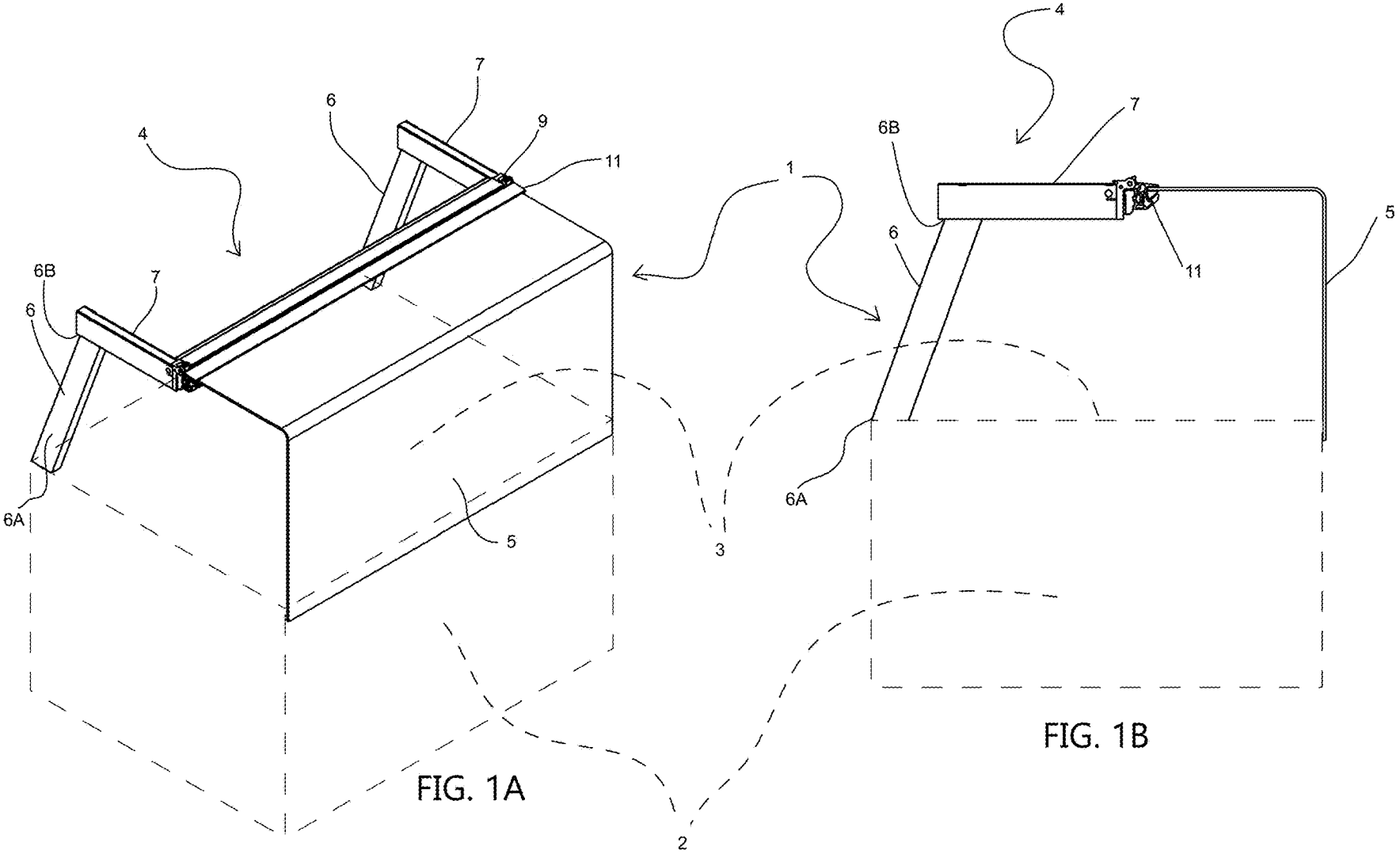
FIGS. 1A and 1B respectively show a top perspective schematic view and a lateral schematic view of a support frame of a shaped panel of a display cabinet for showcasing products according to the present invention.

With the aforementioned idea in mind, an example of a cabinet for displaying products according to the present invention is schematically shown in FIG. 1 and indicated with reference numeral 1. It comprises a base 2 for resting on the ground (shown in dashed line) which is generally closed and on which there is fixed a shelf 3 (shown with dashed line) for supporting products (not shown). Such shelf is then surmounted by a frame 4 carrying at least one panel or sheet 5 adapted to avoid—on the one hand-direct contact with the products and their preservation, and—on the other hand—allow them to be viewed. The panels or sheets may be made of glass or transparent plastic and can be on all sides—upper, front, rear and lateral—depending on the needs or preferences. In any case, at least one of the two front and rear sides, that is the first facing towards the operators and the second towards the customers, can be opened to allow the handling of products and the interior and exterior cleaning of the panels.

The frame 4 comprises at least two uprights 6 with a first end 6A fixed to said shelf 3 and a second end 6B fixed to a support 7 for a system for moving the sheets 5. In the embodiment shown in the example of FIG. 1, the uprights 6 are two, parallel and slightly inclined with respect to the plane of the shelf 3. Furthermore, the uprights are fixed to the base using conventional means such as screws and nuts, or other known systems (not shown).

Figure 2:
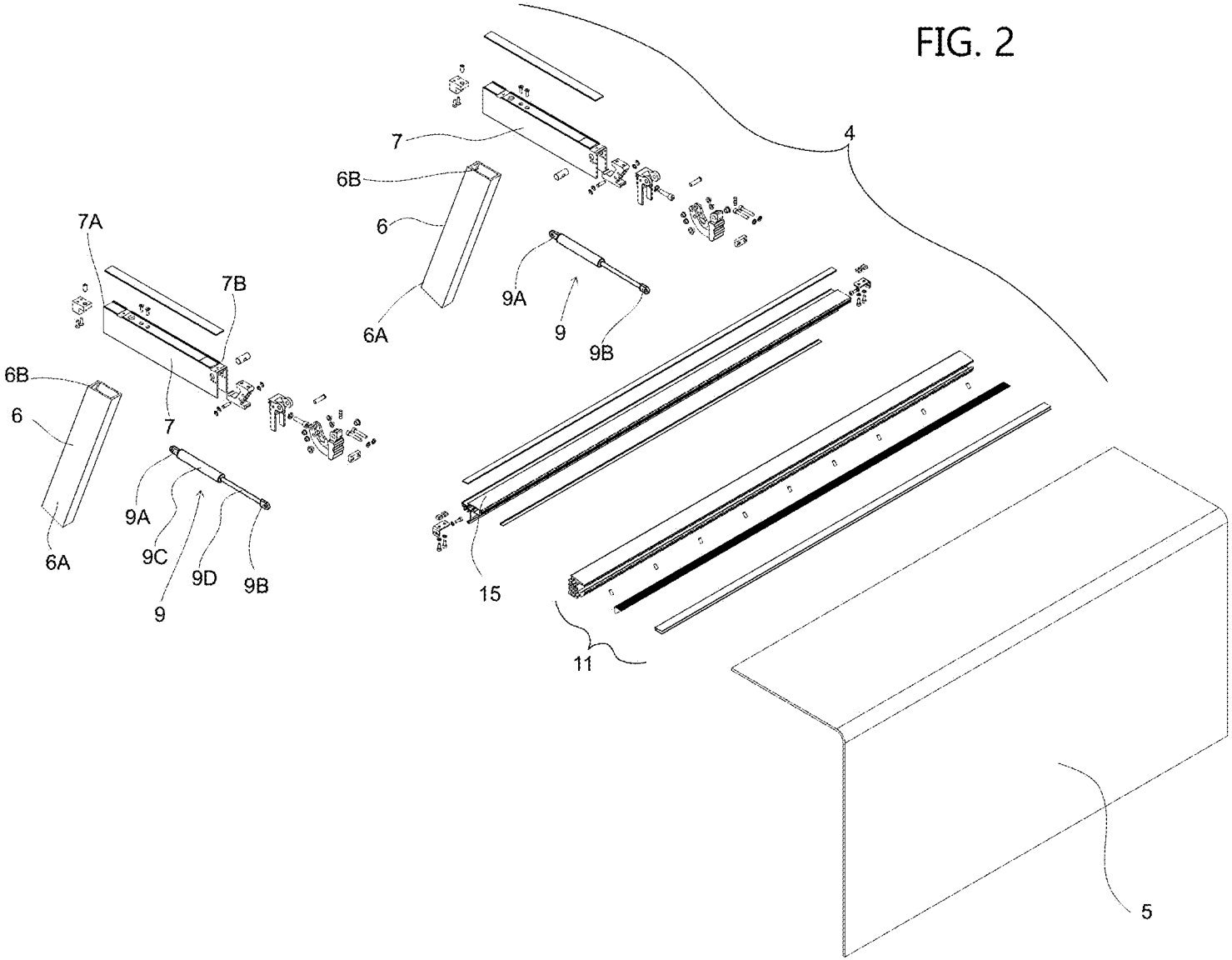
FIG. 2 shows a top perspective and exploded view of the frame of FIG. 1 according to a first embodiment of the invention.
Figure 3:
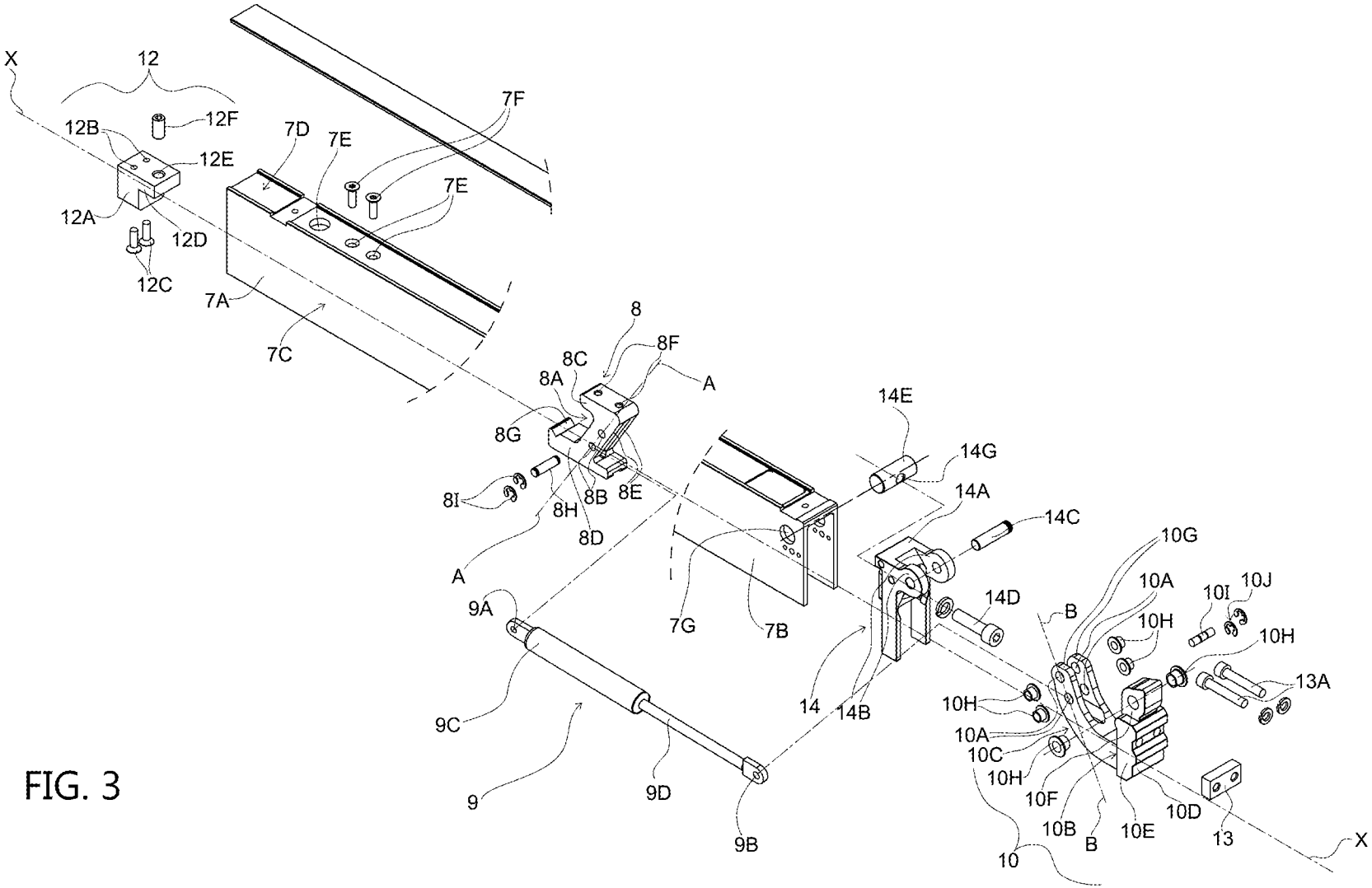
FIG. 3 shows an enlargement of the exploded view of the mechanics of the movement system of the frame of FIG. 2.
Figure 4C:
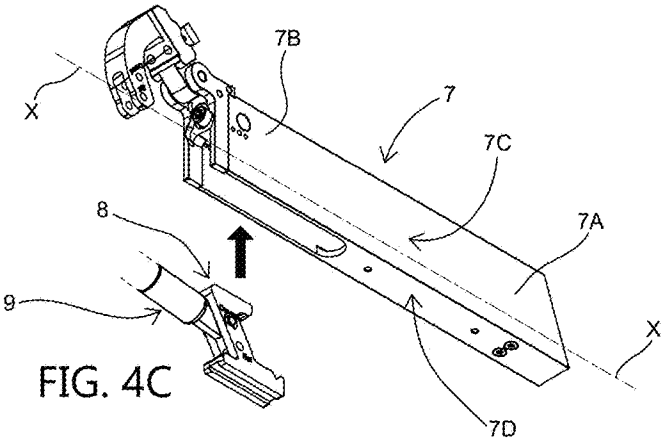
FIGS. 4A-4D show steps for assembling a fixing element of an end of an element for retaining a panel in the frame of FIG. 2 according to said first embodiment of the invention.
Figure 4D:
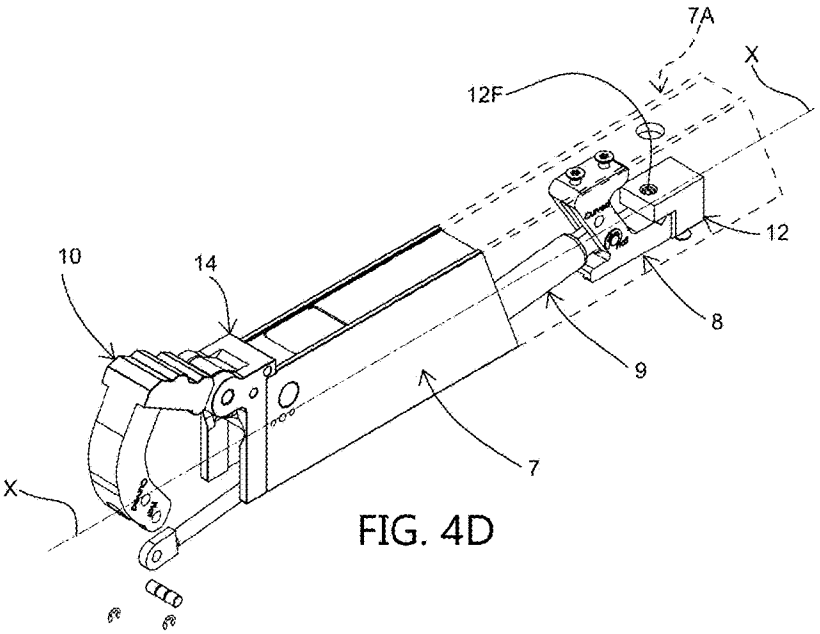

The supports 7 are conventional box-like sections that extend hollow on a straight axis X-X to accommodate the mechanics of the movement system of a 5 panel (FIGS. 2, 3, 4C and 4D). Said sections extend between a first end 7A for connection with said second end 6B of an upright 6, and a second end 7B for connection with a sheet 5 (FIGS. 1 and 3). Preferably, the sections have a rectangular cross-section with two parallel and opposite larger longitudinal walls 7C, and two parallel and opposite smaller longitudinal walls 7D (FIGS. 3 and 4C). Furthermore, as shown in FIG. 4C, a smaller wall 7D is at least partially open, same case applying to the second end 7B, and preferably also the first end 7A, is axially open. Preferably, a pair of holes (not shown) are present on the smaller longitudinal wall 7D provided with an opening and in proximity of the first end 7A of the section. Furthermore, on the opposite smaller longitudinal wall there are obtained at least two holes 7E for engagement with screws 7F for fixing a fixed element 8 (FIG. 3), as explained below.

In particular, as better shown in FIG. 3, the fixing mechanism comprises a first fixed element 8 for supporting a first end 9A of a retaining element 9 within a section 7, a second rotary element 10 or mobile support hinge—on one side—for a second end 9B of said retaining element and—on another side—for a clamp-like element 11 for fastening a panel or sheet 5 to be moved (FIG. 2).

Advantageously, according to a first embodiment of the invention, the first fixed element 8 is a shaped element comprising (FIG. 3) a first portion 8C for fixing to an inner surface of the section 7, a second portion 8D for laying onto a second inner surface of the section 7, opposite to the first surface, and a supporting portion 8A astride said two portions first 8C and second 8D, the last being provided with at least one hole 8B for rotatably connecting said first end 9A of said retaining element 9. Said first fixed element 8 is then able to be fittingly inserted into the section 7. Preferably, the portions first 8C and second 8D are plate-like and parallel to each other, while the support portion 8A extends preferably oblique between them.

According to a variant of the present embodiment of the invention, the support portion 8A is provided with at least a circular hole 8B or elongated hole, preferably there are two circular holes. According to a particular variant of the present embodiment, when the holes are two or an elongated hole, these are arranged on an oblique line A-A with respect to said section X-X of said section 7.

According to a preferred variant of the present embodiment of the invention, the supporting portion 8A consists of two parallel walls 8E defining a space for the insertion of said first end 9A of said retaining element 9. Furthermore, these two walls each have two circular through holes 8B transversely aligned two by two. Preferably, the two first 8C and second 8D portions are partially transversely staggered and at least one, preferably the first, has two through holes 8F for engagement with fixing means 7F, as screws, in the section. In addition, the second portion 8D preferably comprises a groove 8G for engagement with further means for fixing said fixed element 8 in the section 7, as explained below. In particular, the groove faces towards the first portion 8C and it is freely accessible in the orthogonal direction due to the above-mentioned staggering of the two first and second portions.

Furthermore, the fixed element 8 comprises a retaining pin 8H and respective retaining rings 8I for rotatably constraining said first end 9A of the retaining element 9, as described below.

According to a further preferred variant of the present embodiment of the invention, the fixed element 8 of the system for moving the panel or sheet 5 comprises safety means for ensuring that said element 8 is fixed in the operative position in the section 7. In particular, said safety means comprise a block 12 (FIG. 3) provided with a body 12A for fixing to the inner surface of said section opposite to the fixing wall of the first portion 8C for fixing the fixing element 8. Said body comprises two engagement holes 12B with corresponding screws 12C. Furthermore, from the body there extends a bracket 12D with through-hole 12E for inserting a taper screw 12F for engagement with the above-mentioned groove 8G of the first fixed element 8, as explained below.

Figure 5:
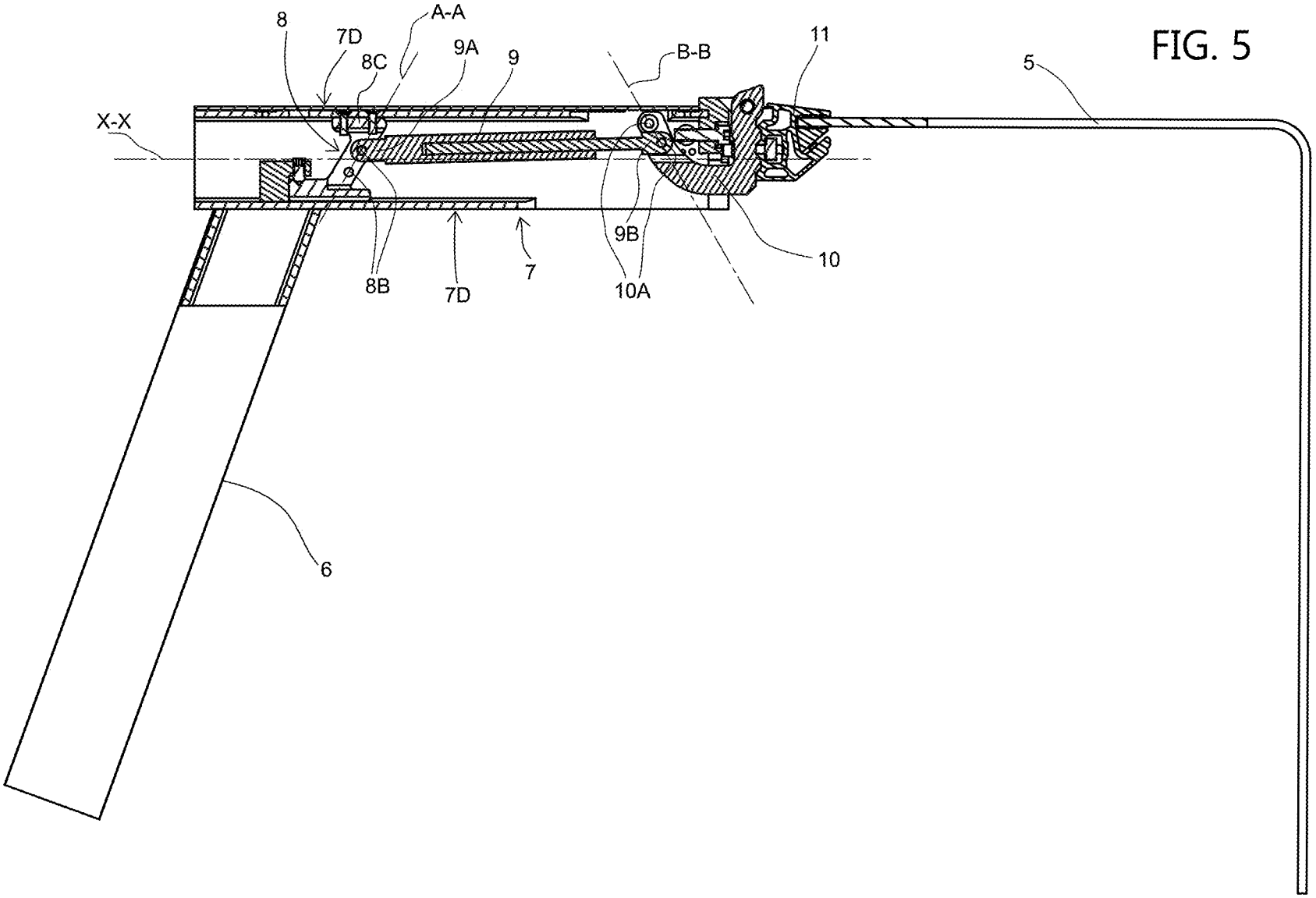
FIG. 5 shows the view of FIG. 1B, enlarged and in cross-sectional view.

The second rotary element 10 of the movement system according to the invention comprises at least one circular hole 10A (as shown in FIG. 3) or an elongated hole, preferably the holes are two circular holes. According to a particular embodiment, the two circular holes are arranged in an oblique line B-B with respect to said axis X-X of the section 7, as better shown in FIG. 5. It should be observed that the inclination of the oblique lines A-A, B-B respectively of the holes 8B of the fixed element 8 and the holes 10A of the rotary element 10 is opposite, when the retaining element 9 lies in the inoperative condition in the section (FIG. 5). This particular geometry of the holes of each of the fixed 8 and rotary 10 elements advantageously allows the versatility of the entire system for moving the straight or bent sheets or panels, without the need of changing the mechanics but simply changing the inserting position of the first 9A and second 9B ends of the retaining element 9.

Generally, the rotary element 10 has an entirely conventional shape and preferably comprises a body 10B for rotatably fixing to said second end 7B of the section 7 and an arm 10C. The body has two main faces 10D (only one visible in FIG. 3) opposite and connected by a perimeter edge 10E. On the perimeter edge 10E there is also provided for a protrusion 10F provided with a hole for engagement with a rotation pin, as explained below.

According to a preferred embodiment, both the hole of the protrusion 10F of the body 10B and each 10A hole of the arm 10C comprise a wear-resistant bushing 10H, preferably made of plastic material.

According to a further embodiment, the main face 10D of the body 10B, opposite to that from which the arm 10C protrudes, comprises a plate 13 fixed to said face using conventional retaining screws 13A, for forming a kind of slidable engagement with the aforementioned clamp-like element 11 to support plate 5, as explained below.

In particular, the arm 10C extends from one of said two main faces 10D and is passed through by said at least two holes 10A or elongated hole. Preferably, the arm is formed by a two-branch fork 10G each with at least one hole or a single elongated hole, the holes being transversely aligned with respect to each other. The space defined between the two branches is such to house the aforementioned second slot-like end 9B of the retaining element 9. A pin 10I for rotatably locking of the retaining element 9 then engages a hole 10A for each branch 10G and, at the same time, the hole of said second end 9B, as described below. Preferably, a pair of Seeger rings 10J hold said locking pin 10I in place.

The rotation element 10 is then connected to the second end 7B of the section 7 through a support 14. This is a conventional element and it generally comprises a body 14A from which there extend two slotted branches 14B defining an engagement space fitting the size of the aforementioned protrusion 10F of body 10E of rotation element 10 so that the respective holes are aligned transversely with respect to the axis X-X. A corresponding pin 14C engages said holes of the rotation element 10 and the two branches 14B to allow the rotation of the former on the latter. Furthermore, the support 14 is locked to the second end 7B of the section by engaging a screw 14D which passes through the body 14A in the direction of the axis X-X and it is inserted into a hole 14G of a retaining pin 14E transversely inserted into two holes 7G of said second end 7B, opposite and obtained one on each of said larger longitudinal walls 7C (FIG. 4).

The retaining element 9 is preferably a gas strut with the first end 9A formed as a slot and fixed on the cylinder 9C, while the second end 9B is also a slot but fixed on the slidable stem 9D of the plunger (FIG. 3).

It will be disclosed now the assembly of the mechanism according to the present invention.

First and foremost, the support 14 is fixed to the axial edge of the second end 7B of the section 7 in an entirely conventional manner, that is not herein disclosed.

The rotation element 10 can now be mounted on the support after fixing the plate 13, using screws 13A, on the face 10D of the body 10B opposite to the one from which the arm 10C protrudes (FIG. 3). Assembly is conventionally done by inserting the protrusion 10F into the space between the two branches 14B of the support 14 so as to align the respective holes and, therefore, allow to lock in place using the pin 14C inserted between them and secured by conventional retaining rings (not shown).

Figure 4A:
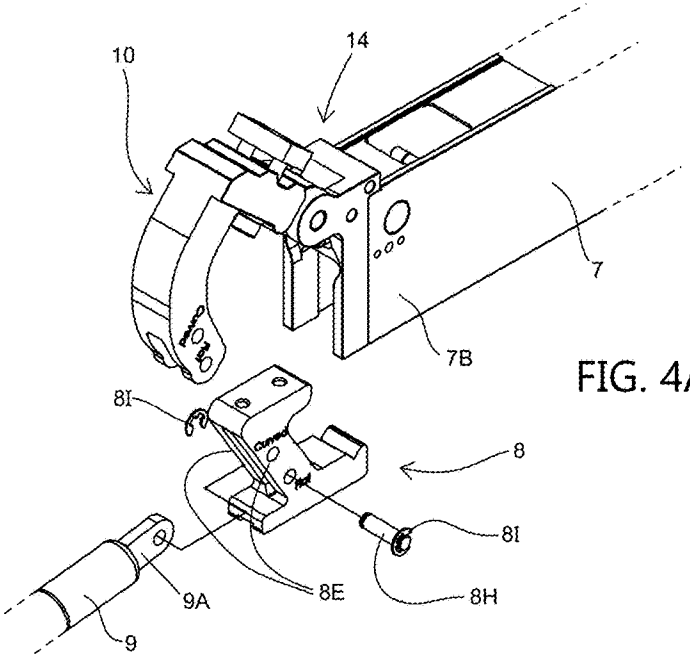
Figure 4B:
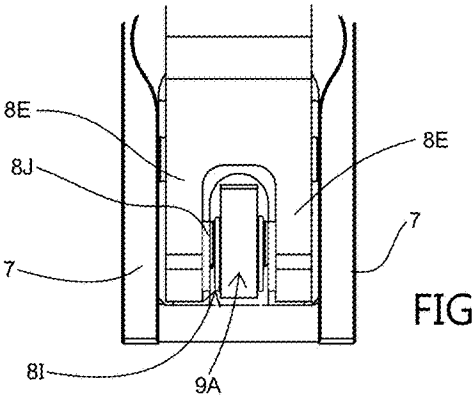

Subsequently, as shown in FIG. 4A, the first end 9A of the retaining element 9 is inserted into the space defined by the two walls 8E of the fixed element 8, so that the respective hole is aligned with a hole 8B of each wall. In this position, the retaining pin 8H is inserted into the aforementioned hole 8B of one of the two walls 8E so that it also passes through the hole of the first end 9A of the retaining element 9 and the hole 8B of the second wall 8E. Furthermore, the retaining rings 8I are mounted on the pin 8H. Preferably, before inserting the first end 9A between the two walls 8E, wear-resistant bushings 8J like the ones described for the rotary element 10 may be inserted into said holes 8B (FIG. 5B).

Alternately, if the supporting portion 8A of the fixed element 8 was made by a single holed piece, la first end 9A of the retaining element 9 is flanked so that respective holes are aligned. Now, the pin 8H and corresponding retaining rings 8J block the reciprocal position, preferably with the interposition of the anti-wear bushes.

The fixed element 8 thus mounted on the first end 9A of the retaining element 9 is inserted into the section 7 from the opening of the smaller longitudinal wall 7D (FIG. 4C) and herein fixed at the first end 7A of the section using two conventional screws 7F which engage the holes 8F of the first portion 8C of the fixed element 8.

According to a preferred embodiment of the invention, before fixing the fixed element 8 in the section 7, the safety block 12 is inserted into the section 7 and fixed in proximity of the first end 7A using screws 12C which pass through the holes of the smaller longitudinal wall 7D provided with an opening for engaging corresponding holes (not shown) of the body 12A of said block.

Upon fixing the block 12, the first end 9A with the element 8 fixed is inserted into the section 7 as described above, until the second portion 8D of the element abuts against the body 12A of the block in the space defined by the bracket 12D. This will allow to align the hole 12E of the bracket with the groove 8G of said second portion 8D. At this point, the taper screw 12F may be inserted into hole 7E of the smaller longitudinal wall 7D of the section, opposite to the one provided with opening, and screwed into the hole 12E until the tip engages said groove 8G and safely locks the fixed element 8 (FIG. 5D). The screwing of the two screws into the holes 8F of the fixed element 8 as explained above then strengthens the locking.

Subsequently, the second end 9B of the retaining element 9 is blocked onto the arm 10C of the rotating element 10 in a conventional manner. Alternately, when said arm is formed by two branches 10G, the second end is inserted into their space so as to transversely align the hole of the second end with one of the holes 10A of the rotary element. The retaining pin 10I is then inserted into said holes and locked therein using conventional Seeger rings 10J.

Once the sections 7 have been prepared as described above, a connection profile 15 can be mounted between two sections 7. This profile is fixed—using support brackets—to the second ends 7B of the profiles in an entirely conventional manner. Therefore, it will not be explained in detail hereinafter.

Figure 7C:
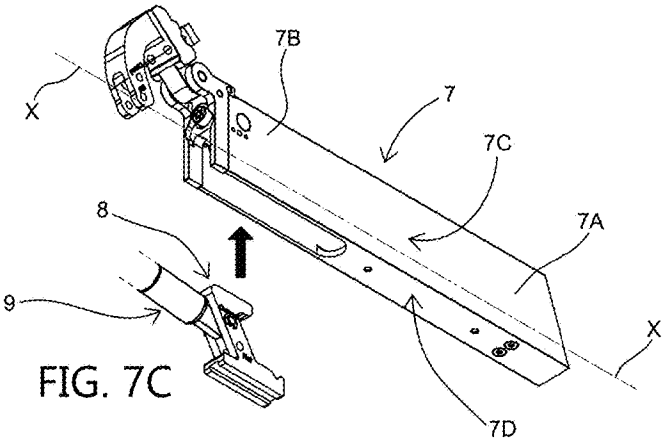
FIGS. 7A-7D show steps for assembling a fixing element of an end of an element for retaining a panel in the frame of FIG. 2 according to said second embodiment of the invention.
Figure 7D:
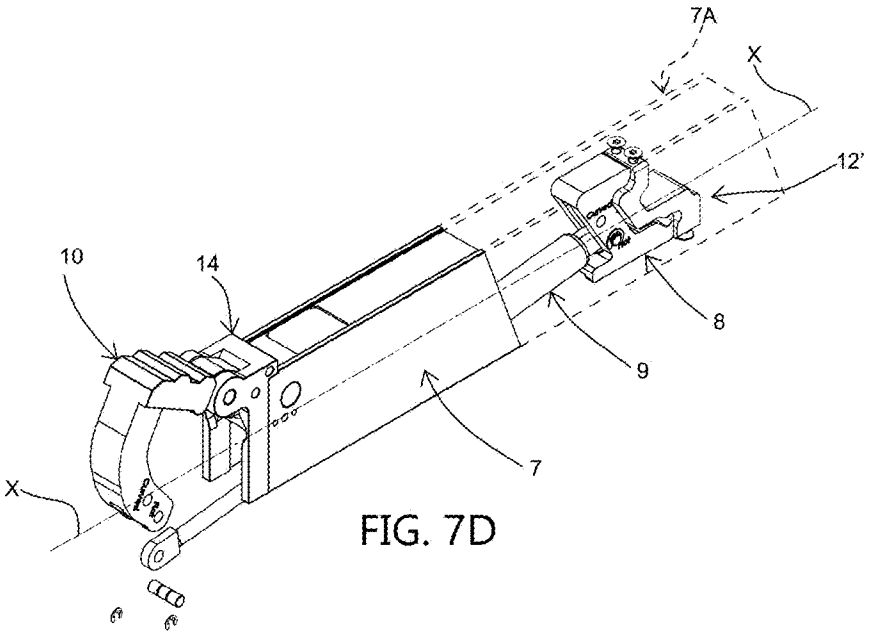
Figure 7A:
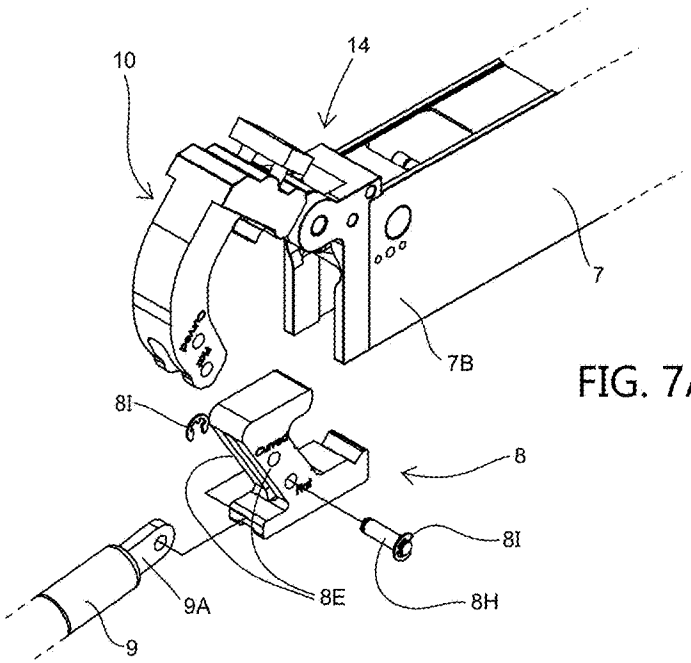
Figure 7B:
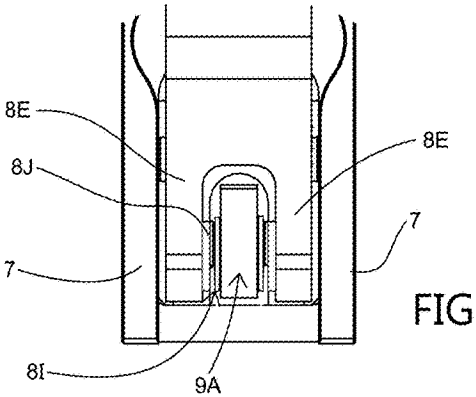
Figure 8:
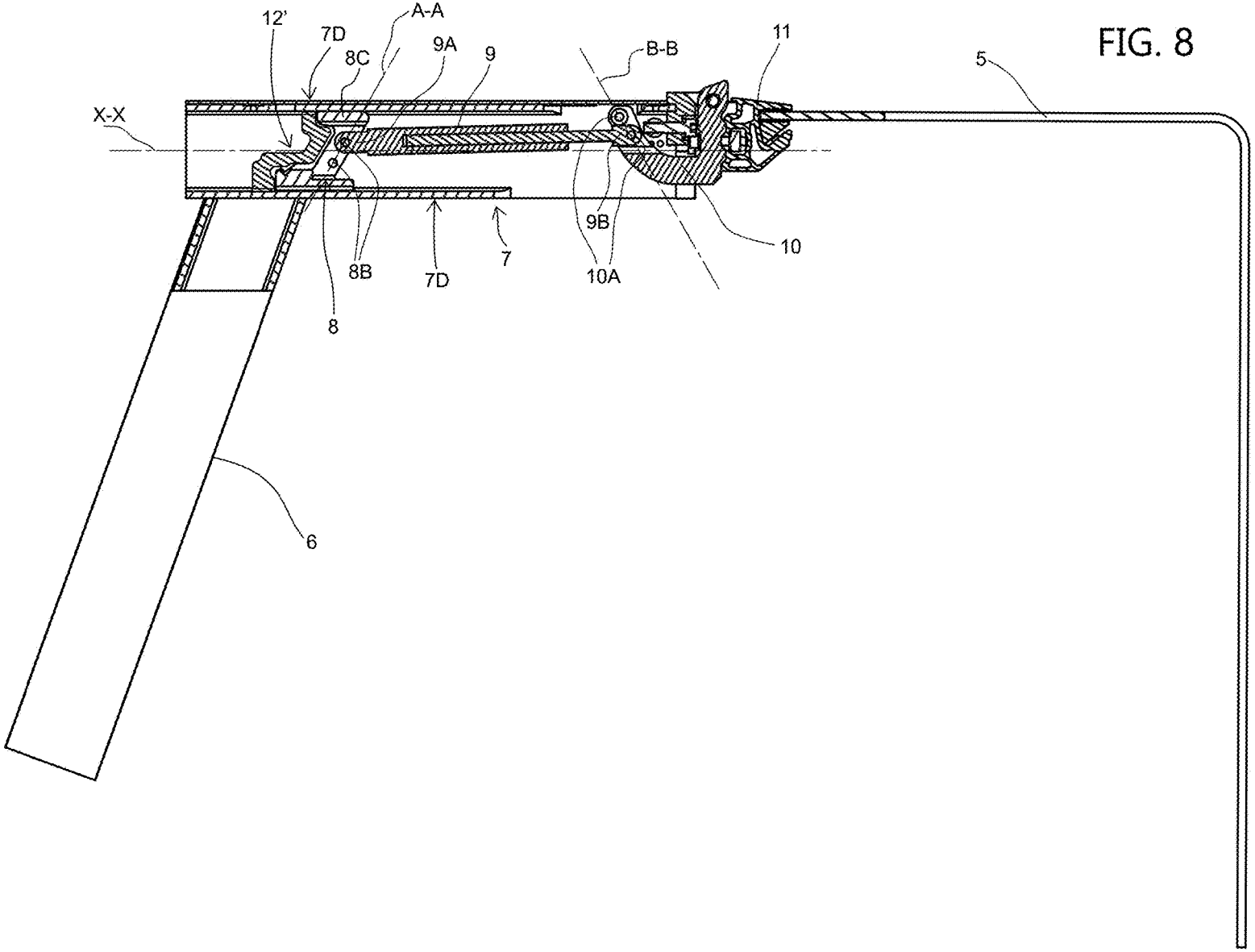
FIG. 8 shows an enlarged lateral view of the frame of FIG. 1B, in cross-sectional view, according to said second embodiment of the invention.

In this configuration, the two profiles 7 are ready to receive the clamp-like element 11, according to the prior art (FIGS. 7A and 7B).

From what has been disclosed above, it is evident that the presence of a fixed element 8 which is coupled to one slotted end of the retaining element before being introduced into the section advantageously allows to speed up, simplify and make the assembly of the system of the invention more precise. Furthermore, providing an additional safety element facilitates the assembly further and makes the mechanism even stronger.

The wear of the pins which are subject to rotation is also prevented by providing wear-resistant plastic bushings.

Numerous changes can be implemented by the person skilled in the art, but without departing from the scope of protection of the attached claims.

For example, the shapes described and represented may vary depending on specific needs or preferences.

Moreover, according to a second embodiment of the present invention, the fixed element 8 can be reversibly blocked within the section 7 even in a simpler and easier manner with respect to the above embodiment.

Figure 6:
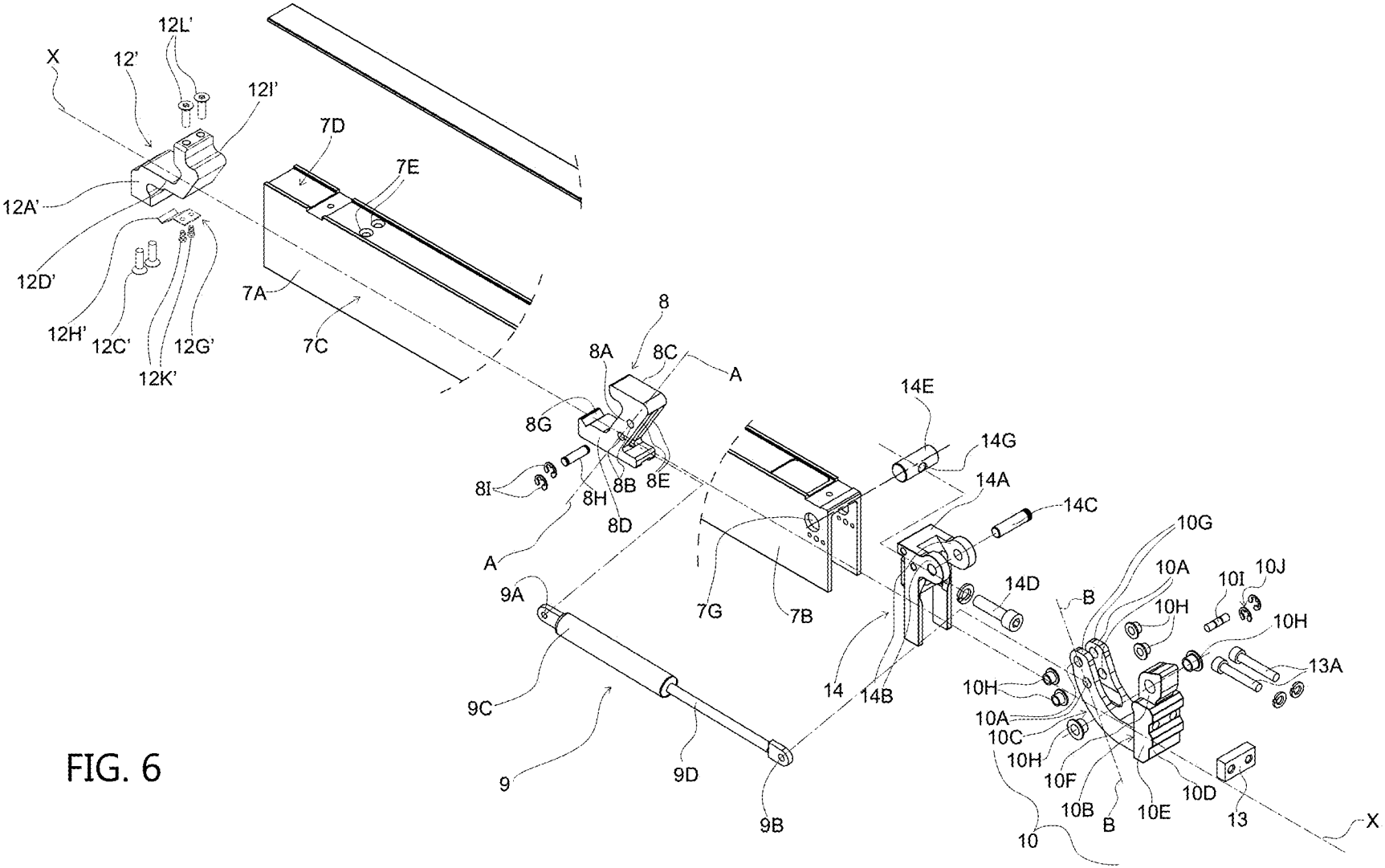
FIG. 6 shows a top perspective and exploded view of the frame of FIG. 1 according to a second embodiment of the invention.

With reference to FIG. 6, all the above described elements of the frame are substantially the same with the exemption of minor modifications of the fixed element 8, and the block 12. In particular, preferably the first portion 8C of the fixed element 8 can have no through holes 8F and it is adapted to rest to an inner surface of the section 7, the second portion 8D being adapted to rest onto a second inner surface of the section 7 opposite to the first surface and a third portion 8A being astride between the first and second portions. The third portion 8A is provided with at least one hole 8B which can be engaged with a respective pin 8H according to the above first embodiment.

The block 12' comprises a body 12A' for fixing to the inner surface of said section 7, as above, trough screws 12C' engaging corresponding holes (not shown). From the body, a bracket 12D' extends having a surface (not indicated) towards the longitudinal minor surface 7D of the section 7 provided with the aperture as per the first embodiment. Advantageously, said surface is provided with a releasable retaining element 12G' acting as a spring. Preferably, said element is an elastic plate provided with a free-elastic tooth 12H' adapted to engage said groove 8G of the first fixed element 8.

The elastic plate 12G' can be fixed to the surface of the bracket 12D' by means of screws 12K', as shown in FIG. 6. However, other suitable means known in the art can be used as for instance welding, rivets. Screws are preferred since in case of breakages or undue bending, the plate can be easily substituted.

Preferably, from the bracket 12D' an arm 12I' extends towards the minor surface 7D of the section 7 opposed to said body 12A' of the block 12. This arm can be removably fixed to said minor surface by means of screws 12L' engaging the above holes 7E of the same minor surface and corresponding holes (not indicated in FIG. 6) of said arm. In this manner, the block 12' is firmly fixed into the section 7 but can be easily removable if necessary.

The main advantage of the above second embodiment of the invention is that the assembling, but specially the disassembling, of the fixed element 8 into the section 7 is simpler. In particular, as shown in FIGS. 13A and 13B, the fixed element with the retaining element 9 is prepared according to the above description of the first embodiment. Then, the block 12' is inserted into the section 7 and fixed in proximity of the first end 7A using screws 12C' (FIG. 13C) which pass through the holes of the smaller longitudinal wall 7D provided with an opening, for engaging corresponding holes (not shown) of the body 12A' of said block. Similarly, the arm 12I' of the block is fixed to the smaller longitudinal wall 7D opposite to the one with the opening, by means of screws 12L' (FIG. 13D).

Afterwards, the fixed element 8 is inserted into the section 7 from the opening of the smaller longitudinal wall 7D (FIG. 13C). Then, the fixing element is pushed against the block 12' forcing its second portion 8D to elastically pass the tooth 12H' of the releasable retaining element 12G'. In this manner, said tooth snaps into the groove 8G of the fixed element 8 so that to releasable but firmly retaining the same element in a safety working position (FIG. 13D).

Should the retaining element 9 be disassembled for any reasons, it is sufficient to pull with a predetermined force the same element out of the section 7 overcoming the spring force of the releasable retaining element 12G'.

The invention claimed is:

1. Frame for supporting and displacing a sheet or panel of a display cabinet or counter for product showcases, the frame comprising:

at least one hollow section; and a mechanism connected to a retaining element of the sheet or panel, the mechanism being configured to be housed in the hollow section, the mechanism comprising a fixed support element that supports a first end of the retaining element, wherein a second end of the retaining element is connected to the sheet or panel, and the fixed support element comprises:

a first portion configured to abut against a first inner surface of the hollow section, a second portion configured to abut against a second inner surface of the hollow section, the second inner surface being opposite to the first inner surface, and a third portion that integrally connects the first and second portions, such that the first, second, and third portions are one piece, the third portion being provided with at least one hole, the at least one hole being engageable by a pin for fixing to the first end of the retaining element.

2. Frame according to claim 1, wherein:

the third portion of the fixed support element comprises two parallel walls defining a space for inserting the first end of the retaining element, and the at least one hole comprises (i) two through holes in each of the two parallel walls, each through hole of one of the two walls being transversely aligned with a respective one of the through holes of the other of the two walls, or (ii) an elongated hole in each of the two parallel walls.

3. Frame according to claim 1, wherein the first and second portions of the fixed support element are parallel, transversely partially staggered, and at least one of the first portion or the second portion has a hole for engagement with the hollow section by fixing means.

4. Frame according to claim 3, wherein the second portion includes a groove facing away from a surface of the second portion that abuts against the second inner surface of the hollow section.

5. Frame according to claim 4, further comprising a block provided with a body for fixing to the inner surface of the hollow section and a bracket with a through hole for inserting a screw for engagement with the groove of the second portion of the fixed support element.

6. Frame according to claim 1, wherein the at least one hole comprises a wear-resistant bushing.

7. Openable display cabinet for show-casing products, comprising:

a base for resting on a ground;

a shelf for supporting the products, the shelf being fixed to the base; and the frame according to claim 1, fixed on the base and carrying at least one panel or sheet adapted to separate the products from an external environment.

8. Frame for supporting and displacing a sheet or panel of a display cabinet or counter for product showcases, the frame comprising:

at least hollow section; and a mechanism connected to a retaining element of the sheet or panel, the mechanism being configured to be housed in the hollow section, the mechanism comprising a fixed support element that supports a first end of the retaining element, wherein a second end of the retaining element is connected to the sheet or panel, and the fixed support element comprises:

a first portion configured to abut against a first inner surface of the hollow section, a second portion configured to abut against a second inner surface of the hollow section, the second inner surface being opposite to the first inner surface, and a third portion that integrally connects the first and second portions, such that the first, second, and third portions are one piece, the third portion being provided with at least one hole, the at least one hole being engageable by a pin for fixing to the first end of the retaining element, wherein the fixed support element engages in a releasable snap-in manner a block fixed within the hollow section to removably fix the retaining element in its working position.

9. Frame according to claim 8, wherein the block comprises:

a body for fixing to the second inner surface of said hollow section, a bracket extending from the body, and a releasable retaining element acting as a spring, the releasable retaining element extending from the bracket.

10. Frame according to claim 9, wherein the releasable retaining element is an elastic plate adapted to engage a groove of the second portion of the fixed support element.

11. Frame according to claim 9, wherein the block further comprises an arm extending from the bracket towards the first inner surface of the hollow section to be removably fixed to the first inner surface.

* * * * *